US006290149B1

(12) United States Patent
Daniel, III et al.

(10) Patent No.: US 6,290,149 B1
(45) Date of Patent: Sep. 18, 2001

(54) ROMAN TUB STREAM FORMER

(75) Inventors: John H. Daniel, III, Strongsville; Allen L. Talley, Hudson, both of OH (US)

(73) Assignee: Moen Incorporated, North Olmsted, OH (US)

( * ) Notice: Subject to any disclaimer, the term of this patent is extended or adjusted under 35 U.S.C. 154(b) by 0 days.

(21) Appl. No.: 09/567,277

(22) Filed: May 9, 2000

(51) Int. Cl.[7] ..... B05B 1/14

(52) U.S. Cl. ..... 239/590; 239/504; 239/518; 239/524

(58) Field of Search ..... 239/590, 590.3, 239/590.5, 504, 518, 521, 524

(56) References Cited

U.S. PATENT DOCUMENTS

| | | | | |
|---|---|---|---|---|
| 544,412 | | 8/1895 | Magee . | |
| 597,842 | * | 1/1898 | Edmands | 239/590.4 |
| 2,423,960 | | 7/1947 | Bucknell et al. . | |
| 2,622,615 | | 12/1952 | Golden et al. . | |
| 2,744,738 | | 5/1956 | Hjulian . | |
| 2,754,097 | | 7/1956 | Hjulian . | |
| 2,799,487 | | 7/1957 | Aghnides . | |
| 3,130,915 | | 4/1964 | Aghnides . | |
| 3,321,140 | | 5/1967 | Parkison et al. . | |
| 3,713,591 | | 1/1973 | Watkins . | |
| 4,275,843 | * | 6/1981 | Moen | 239/494 |
| 4,294,289 | | 10/1981 | Fischer . | |
| 4,657,186 | | 4/1987 | Shapiro . | |
| 4,757,841 | | 7/1988 | Lucas . | |
| 5,215,260 | | 6/1993 | Robbins . | |
| 5,495,985 | | 3/1996 | Nehm et al. . | |
| 5,603,363 | * | 2/1997 | Nelson | 222/351 |

* cited by examiner

*Primary Examiner*—David A. Scherbel
*Assistant Examiner*—Dinh Q. Nguyen
(74) *Attorney, Agent, or Firm*—Cook, Alex, McFarron, Manzo, Cummings & Mehler, Ltd.

(57) ABSTRACT

A faucet spout, for example a roman tub spout, includes a spout body with a water passage in the body. The water passage has a discharge end and there is a stream former positioned at the discharge end of the water passage to form water flowing from the faucet spout into a hollow water curtain. The stream former includes a centrally positioned disk defining an annular flow path with an interior wall of the water passage. The disk has arms which extend outwardly therefrom and interlock with a recess on the water passage interior wall to mount and position the stream former at the discharge end of the spout.

5 Claims, 1 Drawing Sheet

ROMAN TUB STREAM FORMER

THE FIELD OF THE INVENTION

Faucet spouts, and more particularly roman tub spouts, may discharge water from a substantial height above a basin or tub and it is desired that the flow of water over such a substantial distance have a pleasing appearance. Traditionally, the cross sectional area of a roman spout discharge is shaped like a horn and the frictional force between the water flowing through the discharge and the interior wall of the spout causes what is termed a stream line separation which provides an incomplete water curtain. Such may detract from the appearance of a roman tub spout, particularly if the spout is set in a bath having an overall luxurious feel. The present invention is specifically directed at providing a stream former for the discharge of a faucet spout or a roman tub spout in which the stream former will provide what appears to be a high amount of the water output in the form of a smooth, fully rounded, hollow water curtain which provides a substantially pleasing appearance and one which appears to naturally flow from the discharge end of the spout. The stream former is simple in construction, reliably operable, and is easily inserted into the discharge end of the spout.

SUMMARY OF THE INVENTION

The present invention relates to a stream former for a faucet spout and in particular to a roman tub spout.

A primary purpose of the invention is a roman tub spout, with a mounted stream former, which provides a water flow pattern from the spout in the shape of a hollow curtain.

Another purpose of the invention is to provide a simply constructed and reliable stream former for a roman tub spout. stream former for a roman tub spout.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Roman tub spouts and high arc kitchen spouts, as well as some types of bar spouts, all provide a water discharge point which is at a substantial height above the basin, sink or tub to which water is directed. It is desirable, particularly in high end or luxurious bath suites, to have the water which discharges from such a height appear to be naturally flowing in a smooth-appearing stream toward the discharge point below. Most particularly in roman tub spouts in which the tub spout is an expensive plumbing product and normally will have a highly decorative and pleasing exterior appearance, it is important that the discharge stream of water appear to flow naturally from the discharge end of the spout. Further, it is desirable that the water flow appear to be soft, pleasing and in keeping with the overall decor of the bath area.

Figure 1:
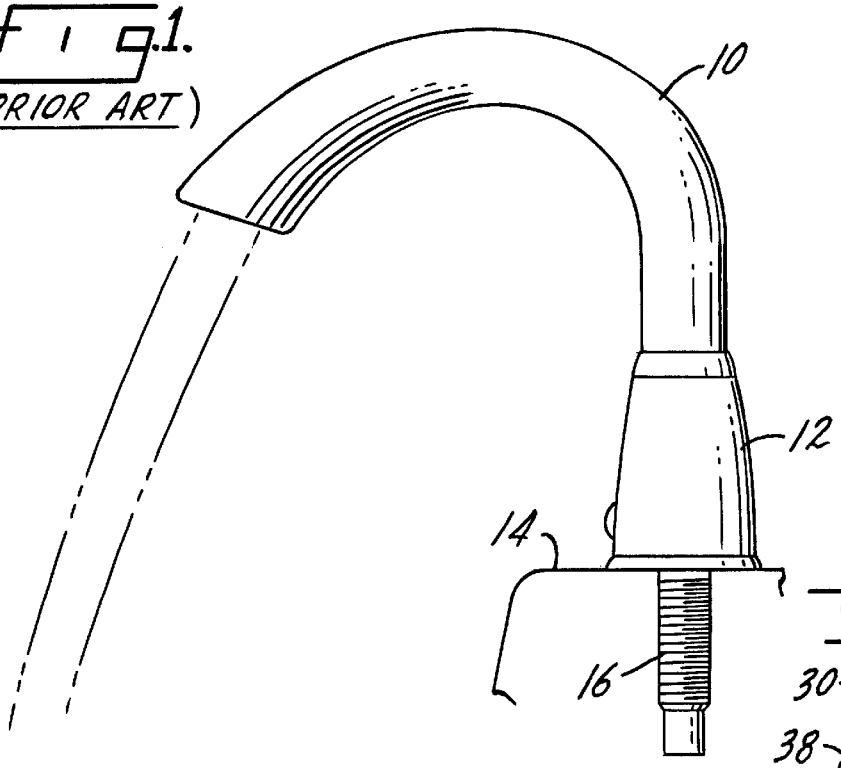
Fig.1. (PRIOR ART)
FIG. 1 is a side view of a roman tub spout having a conventional water discharge shown in broken lines.

The present invention provides a stream former for the discharge end of a roman discharge end of the spout FIG. 1 illustrates a typical roman tub spout in which there is a spout body 10 and a decorative escutcheon 12 which mounts to the top of the tub area 14. A water conduit is indicated at 16. The interior water passage of the spout has a horn-like configuration, as is conventional and shown in FIG. 2. The cross sectional increase of the water passage toward the downstream end of the discharge area, in cooperation with the frictional force between the water flow and the interior wall of the discharge passage, causes stream line separation and an incomplete water curtain.

Figure 2:
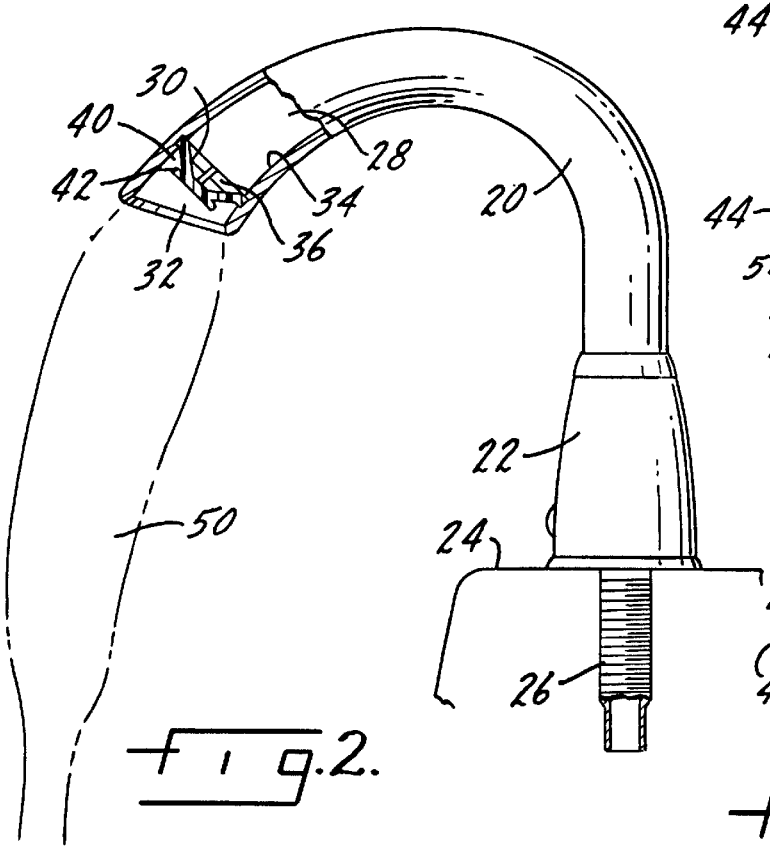
FIG. 2 is a side view, similar to FIG. 2, with a portion of the spout broken away to illustrate a stream former.

FIG. 2 illustrates the Roman tub spout of the present invention. Again, there is a spout body 20 mounted with a hub or escutcheon 22 to the sink deck or tub rim surface 24. A water conduit 26 provides water for flow into the interior of the spout 20 water passageway 28. A stream former 30 is positioned within the water flow passageway 28 adjacent the discharge end 32. The interior wall 34 of the water passageway 28 is horn-shaped adjacent the discharge end 32 of the spout and has an annular recess 36 which is formed and adapted to mount the stream former 30.

Figure 4:
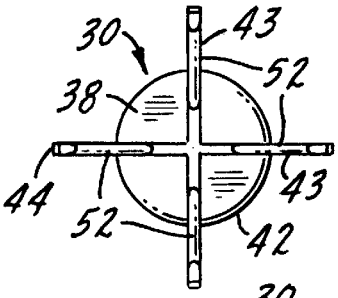
FIG. 4 is a top view of the stream former of FIG. 3.
Figure 3:
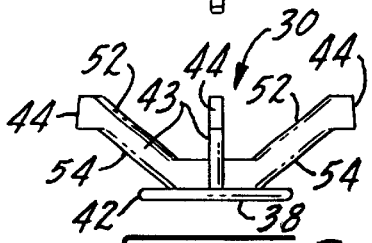
FIG. 3 is an enlarged side view of the stream former.
Figure 5:
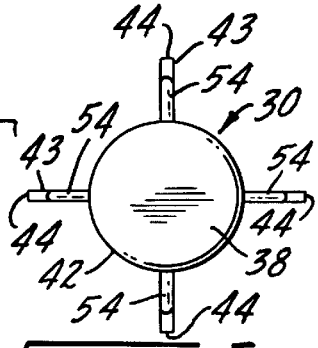
FIG. 5 is a bottom view of the stream former.

The stream former 30, as shown in FIGS. 3,4 and 5, includes a generally central round disk 38, which may be formed of a suitable plastic, as may the other portions of the stream former. The disk 38, as shown in FIG. 2 when mounted in the water passageway 28, forms an annular flow path 40 between the exterior rim 42 of the disk and the interior wall 34 of the passageway 28.

The stream former 30 may have a plurality, in this case four, uniformly spaced arms 43, each of which extends upstream at an acute angle to the disk 38. The arms 43 each terminate in a generally rectangular-shaped projection 44 which is formed and adapted to fit within the recess 36 in the passage 28 to mount the stream former within the spout.

The round shape of the disk 38 cooperates with the passageway 28 to form the annular space 40 which results in a hollow water curtain 50 which forms the water discharge pattern for the spout 20.

The projections 44 tightly fit within the recess 36, but because the stream former is formed of a plastic, and to some degree is flexible, the stream former may be easily snapped into the recess for mounting in the spout.

It is desirable that the arms 42 extend in an upstream direction, so that the disk is downstream of the termination of the arms, as this assists in forming the water curtain 50. Each of the arms 42 may have upper and lower rounded surfaces, indicated at 52 and 54, so as to minimize turbulence within the water passageway as the water flows past the stream former.

Whereas the preferred form of the invention has been shown and described herein, it should be realized that there may be many modifications, substitutions and alterations thereto.

The embodiments of the invention in which an exclusive property or privilege is claimed are defined as follows:

1. A faucet spout including a spout body, a water passage in said spout body, said water passage having a discharge end, and a stream former positioned at said water passage discharge end to form the water flowing from said discharge end into a generally hollow water curtain, said stream former including a centrally positioned disk, said disk defining an annular flow path with an interior wall of said water passage, and means on said disk and the interior wall of said water passage for mounting said disc at the discharge end of said water passage, said means including a plurality of outwardly extending arms on said disk, an annular recess in the interior wall of said water passage, generally adjacent the discharge end of said water passage, with said arms extending into said recess.

2. The faucet spout of claim 1 wherein each of said arms have a projection at the end thereof, with said projections extending into said annular recess.

3. The faucet spout of claim 2 wherein said arms are uniformly spaced, one from another.

4. The faucet spout of claim 3 wherein there are four arms.

5. The faucet spout of claim 2 wherein each of said arms includes a first portion which extends at an acute angle away from the disk to place said stream former downstream of said annular recess, with said projections being located at the end of said arms.

* * * * *